US009139955B2

(12) United States Patent
Joutsimo

(10) Patent No.: US 9,139,955 B2
(45) Date of Patent: Sep. 22, 2015

(54) METHOD OF PROCESSING CHEMICAL PULP

(76) Inventor: Olli Joutsimo, Helsinki (FI)

( * ) Notice: Subject to any disclaimer, the term of this patent is extended or adjusted under 35 U.S.C. 154(b) by 2 days.

(21) Appl. No.: 13/809,508

(22) PCT Filed: Jul. 12, 2011

(86) PCT No.: PCT/FI2011/050651

§ 371 (c)(1),
(2), (4) Date: Jan. 10, 2013

(87) PCT Pub. No.: WO2012/007642

PCT Pub. Date: Jan. 19, 2012

(65) Prior Publication Data

US 2013/0105097 A1 May 2, 2013

(30) Foreign Application Priority Data

Jul. 13, 2010 (FI) ..... 20105799

(51) Int. Cl.

| | |
|---|---|
| ***D21C 1/10*** | (2006.01) |
| ***D21C 3/22*** | (2006.01) |
| ***D21C 3/00*** | (2006.01) |
| ***D21B 1/16*** | (2006.01) |
| ***D21C 3/02*** | (2006.01) |
| ***D21C 9/00*** | (2006.01) |
| *D21C 1/00* | (2006.01) |
| *D21C 5/00* | (2006.01) |
| *D21C 11/00* | (2006.01) |

(52) U.S. Cl.

CPC .. *D21C 3/00* (2013.01); *D21B 1/16* (2013.01); *D21C 1/10* (2013.01); *D21C 3/02* (2013.01); *D21C 3/22* (2013.01); *D21C 9/007* (2013.01); *D21C 1/00* (2013.01); *D21C 5/00* (2013.01); *D21C 11/0007* (2013.01)

(58) Field of Classification Search

CPC ..... D21C 1/06; D21C 1/10; D21C 3/22; D21C 7/00; D21C 7/06; D21C 7/08

USPC ..... 162/26, 234, 246

See application file for complete search history.

(56) References Cited

U.S. PATENT DOCUMENTS

| | | | | |
|---|---|---|---|---|
| 1,915,812 | A * | 6/1933 | Wollenberg | 162/17 |
| 3,591,451 | A | 7/1971 | Wilder | |
| 4,121,967 | A | 10/1978 | Reinhall | |

(Continued)

FOREIGN PATENT DOCUMENTS

| | | | |
|---|---|---|---|
| CA | 1066697 | A1 | 11/1979 |
| FI | 68680 | C | 10/1985 |
| WO | 03/000983 | A1 | 1/2003 |

OTHER PUBLICATIONS

Joutsimo Olli, Effect of Mechanical Treatment of Softwood Kraft Fiber Properties (dissertaion), Nov. 2004, Helsinki University of Technology.*

(Continued)

*Primary Examiner* — Anthony Calandra

(74) *Attorney, Agent, or Firm* — Ziegler IP Law Group, LLC.

(57) ABSTRACT

A method is presented, by which dewatering in paper product production, optical properties, bulk and surface smoothness of the paper product can be increased. The method involves at least one step physical treatment of the vegetable fiber raw material.

14 Claims, 5 Drawing Sheets

(56) References Cited

U.S. PATENT DOCUMENTS

| | | | | |
|---|---|---|---|---|
| 4,869,783 | A | 9/1989 | Prusas et al. | |
| 4,915,830 | A | 4/1990 | Mackay et al. | |
| 4,953,795 | A | 9/1990 | Bielagus | |
| 5,338,405 | A | 8/1994 | Patt | |
| 5,385,309 | A | 1/1995 | Bielagus | |
| 5,570,850 | A | 11/1996 | Kay | |
| 5,622,598 | A | 4/1997 | Prough | |
| 5,643,410 | A | 7/1997 | Hiljanen et al. | |
| 5,736,005 | A * | 4/1998 | Flodquist | 162/52 |
| 6,036,818 | A | 3/2000 | Odmark | |
| 6,174,411 | B1 | 1/2001 | Laakso et al. | |
| 6,458,245 | B1 | 10/2002 | Hoglund et al. | |
| 6,533,896 | B1 | 3/2003 | Tikka | |
| 2001/0032711 | A1 | 10/2001 | Stromberg | |
| 2003/0041982 | A1 | 3/2003 | Prior | |
| 2004/0089430 | A1 * | 5/2004 | Fant et al. | 162/19 |
| 2004/0244925 | A1 | 12/2004 | Tarasenko | |
| 2004/0256065 | A1 | 12/2004 | Ahmed | |
| 2005/0053496 | A1 | 3/2005 | Danielsson et al. | |
| 2007/0062654 | A1 | 3/2007 | Wang | |

OTHER PUBLICATIONS

Joutsimo et al., The Effect of Mechnical Treatment on Softwood Kraft Pulp Fibers, 2004, Paperi ja Puu—Paper and Timber, 86 (5), p. 359-364.*

Grace editor, Pulp and Paper Manufacture: Alkaline Pulping, 1989, The Joint Textbook Committee of the Paper Industry, vol. 5 3rd edition, p. 49-55, 68-71,and 98-113.*

PSE 476, Pulping and Bleaching Lecture #6, downloaded online Nov. 7, 2013.*

Salmen, L., Temperature and water induced softening behavior of wood fiber based materials. Department of Paper Technology, The Royal Institute of Technology. Stockholm, Dissertation 1982, 114p.

* cited by examiner

METHOD OF PROCESSING CHEMICAL PULP

BACKGROUND

1. Field

The aspects of the disclosed embodiments relate to a method of pulping wood or non-wood, and papermaking wherein the amounts of effluents generated by these processes are decreased, and more specifically to a process of chemical pulping and papermaking providing a processing step contributing especially to an improvement in chemical consumption, washing efficiency and dewatering of pulp, yielding enhanced final paper product properties and higher productivity.

2. Brief Description of Related Developments

Pulp washing and dewatering of the fibers in pulping and papermaking processes creates a substantial amounts of effluents, consumption of bleaching chemicals, increases the amount of water and energy in these processes.

Pulping processes today commonly include semi chemical, mechanical and chemical pulping processes, which are used for pulping hardwood, softwood and non-wood raw materials. Various additives are used in order to improve economy in chemical consumption and washing of the pulp as well as the economy of the pulp production.

Fibers thereby obtained are generally used in the papermaking processes such as neutral, acidic and alkaline. Various additives are used in order to improve the quality of the paper obtained as well as the economy of the papermaking.

There are patents CA 1066697, U.S. Pat. No. 4,869,783 and Fl 68680 which are teaching some beneficial effects of the mechanical defibration of biomass particles on cooking yield or cooking time, while maintaining paper technical properties of the pulp.

Publication CA 1066697 discloses that rupture and damage to fiber cell caused by processes taught by prior art publications can be avoided by impregnating shredded chips of 2 by 2 mm first with alkali solution of weaker chemical activity whereby inhibiting the delignification of the particles and then with alkali solution of stronger chemical activity. The temperature has to be increased slowly in order to avoid delignification and cell wall damages. This document explicitly teaches that intact lignin layer is necessary for protection against mechanical defibration. The fine size of the chips is also considered as essential.

Similar effect is taught by U.S. Pat. No. 4,869,783 by preheating with steam the biomaterial pieces before separation of the fibers by defibering and leaving the chips partially defibered. It does not teach impregnation prior to defibering. Partially defibered chips and damaged fibers before cooking have fiber middle lamella, which allows in the cooking phase, chemicals to act directly on the middle lamella without passing through the fiber wall as illustrated in FIG. 5. However the method of this disclosure also fails for the same reason as CA 1066697 to improve drainage time or significantly affect the density of the pulp sheet at the same yield or kappa number level. This is evident from the examples 1 to 5 of the publication U.S. Pat. No. 4,869,783.

The publication Fl 68680 teaches how resins can be removed after cooking from washed brown stock pulp pressing the pulp by rotating screws in alkali solution.

Publication U.S. Pat. No. 6,458,245 presents a process for defibering impregnated and preheated wood chips in order to produce chemithermomechanical pulp. The objective of these processes is to remove fibers as intact as possible from the chip matrix and continue with cooking or bleaching process. In this way as described in cited publications above the cell wall will remain intact or will be partially removed/damaged. The general strategy applied in these solutions is to expose and subsequently remove the middle lamella to prompt and contribute to fibre separation.

In the prior art, there are also several patents regarding pulping processes and improving washing and decrease of water usage and chemical consumption in the pulping processes especially in Kraft pulping process.

From the prior art it is known a process for enhancing pulp washing efficiency by decreasing the tendency of lignin to remain with the pulp fraction during washing. In this method, anionic surfactants are added within the washing or pulping operation to enhance the removal of lignin.

It is also known to those in the art, that bleaching of pulp by hydrogen peroxide and in particular to a method of treating pulping liquors by preventing or reducing the breakdown of peroxide by catalase. By consuming hydrogen peroxide, catalase can lower bleaching efficiency and decrease brightness levels of the finished paper, thereby increasing chemical consumption.

There are several patents regarding enhanced dewatering in papermaking and decrease of water usage in papermaking. There are also several patents related to the surface evenness improvements and bulk improvements. There are also patents to improve porosity of the paper especially e.g. for filter papers. There are also patents for improving pulp optical properties and absorbance for e.g. of fluff or softness (bulk) of tissue pulp.

From prior art it is known a method of dewatering aqueous cellulosic pulp slurry which method comprises adding to aqueous slurry of washed cellulosic pulp an effective dewatering amount of a mixture of one or more nonionic surfactants and one or more anionic surfactants.

Experts in the art are also familiar with the general field of fluid absorbing products and, more particularly, to a highly absorbent and flexible pulp sheet. More specifically, the flexible and absorbent sheet comprises densified and mechanically worked cellulosic pulp fluff material which has a high structural integrity and provides a soft, thin and flexible fluid absorbent core having good wicking characteristics, well-suited for use in disposable absorbent products such as sanitary napkins, wound dressings, bandages, incontinence pads, disposable diapers and the like. A method of pre-paring such highly absorbent and flexible cellulosic pulp fluff sheet and its method of use in disposable absorbent products is also provided.

It has been also known from earlier work that by decreasing the amount of hemicelluloses in the fibers the washing and dewatering of the pulp can be enhanced. This can be done for e.g. by cooking the pulp to lower kappa numbers. However this will decrease the cooking yield and therefore increase wood consumption and it is not economically feasible. The use of chemical additives for enhancing the dewatering or washing is also known from the art and will not lead to substantial increase in the dewatering efficiency and will only add an additive to the system which remains therein circulating.

The use of enzymes in bleaching does not usually decrease the cost of bleaching and the amount of effluent generated which is also known from prior art.

From prior art it is also known, that the structure of cellulosic fiber inhibits processing ethanol. Pretreatment is one of the most important operations for practical cellulose conversion processes, and is a key technical barrier to using cellulosic feedstocks for bioconversion. Pretreatment is required to alter the structure of cellulosic biomass to make cellulose more accessible to the enzymes that convert the carbohydrate polymers into fermentable sugars. An effective pretreatment will disrupt the physical and chemical barriers posed by cell walls, as well as cellulose crystallinity, so that hydrolytic enzymes can access the biomass macrostructure. The low accessibility of enzymes into untreated lignocellulosic matrices is the key hurdle to the commercial success of converting cellulosic biomass to biofuel.

Those who are experts in the art also know that, cellulose is characterized by insolubility, in particular in customary solvents of organic chemistry. In general, N-methylmorpholine N-oxide, anhydrous hydrazine, binary mixtures, such as methylamine/dimethyl sulfoxide, or ternary mixtures, such as ethylenediamine/$SO_2$/dimethyl sulfoxide, are nowadays used as solvents. However, it is also possible to use salt-comprising systems such as LiCl/dimethylacetamide, LiCl/N-methylpyrrolidone, potassium thiocyanate/dimethyl sulfoxide, etc. Said application discloses a process for the degradation of cellulose, which comprises dissolving cellulose in an ionic liquid, and treating this solution at elevated temperatures, if appropriate in the presence of water.

Even though many solutions have been suggested, there still remains a need for an environmentally friendly pulping and papermaking process applicable to variety of plants and mills, both planned and existing.

SUMMARY

The aspects of the disclosed embodiments thus provide for environmentally friendly and improved pulping and papermaking methods and dissolution and digestion method of cellulosic material. The disclosed embodiments are especially useful for treating chemical pulps. Another objective is to provide improved paper products from these processes eventually. According to one embodiment, this improvement is achieved by changing the fiber structure in the pulping. The present disclosure is aimed at making pulp or paper using chemical pulping.

Contrarily to results obtained in the prior art, it was also unexpectedly found that the yield of the Kraft cooking process remained the same and no wood consumption increase was observed when applying the method according to the disclosed embodiments. It was also found that the wet web strength was increased. By applying the method, the amount of water used for washing the pulp decreased. Accordingly, the method also yielded decreased chemical consumption.

In one embodiment, the treatment, as a part of pulp production, is done by pressing and/or shearing the impregnated and at least partially delignified fiber agglomerates and fiber walls so that the fiber structure changes.

The change in the fiber structure is preferably done in the conditions of alkali charge and temperature effective to hemicelluloses and the lignins to reach their material softness points respectively. These stages in the Kraft pulping process are in the continuous Kraft cooking processes impregnation, transfer circulation and cooking. In the batch cooking processes it can be done at the same process stages as in the continuous process or in can be incorporated as a separate process before, in, or after Kraft cooking process.

Embodiments of the present disclosure provide certain benefits. Depending on the embodiment, one or several of the following benefits are achieved: enhanced washing of the fibers, decreased chemical consumption in bleaching, decreased water and energy consumption in the pulping and papermaking processes, and increased efficiency of dissolution or enzymatic digestion of lignocellulosic material for biofuel processes. Embodiments of the present disclosure also improve wet web runnability, surface evenness, optical properties, and increase the bulk of the paper product. Environmentally friendly pulping and papermaking process decreases significantly the investment cost and running costs of these processes. It was surprisingly found, that by changing the pulp fiber structure the washing and dewatering efficiency of the pulp is improved.

BRIEF DESCRIPTION OF THE DRAWINGS

FIG. 4 provides an example of the equipment usable for the treatment according to the disclosed embodiments.

DETAILED DESCRIPTION OF THE DISCLOSED EMBODIMENTS

The inventor of the present method and the product thereof, has unexpectedly found, that some or all the benefits discussed above can be achieved by applying physical treatment to raw material in process of chemical pulping. More specifically, herein is provided a method of processing chemical pulp, wherein defibration and/or change in fiber wall is affected by physical treatment of impregnated and at least partially delignified vegetable fibrous material.

Raw material applicable in this method may contain any type of vegetable fibers, including wood and non-wood fibers or possibly mixtures thereof. A preferable vegetable fiber source comprises wood chips. Said vegetable fibers may be treated by alkaline conditions, or bleached by any bleaching method. However, preferably fibers are bleached after treatment. With non-wood material here, is referred to vegetable fibers other than wood which are applicable to pulping, and known to an artisan, such as jute, hemp, bagasse, coconut or straw.

As used herein, "treatment" refers to applying to chemical pulping process a step of physical treatment conventionally absent form such processes. The disclosed method comprises said physical treatment. Here, by "physical treatment" is meant any means of importing to the chemical pulping physical energy to affect the chips and/or fibers. Preferably the physical treatment is done by inducing pressure forces, pressing and/or shearing to the fibers at the above mentioned conditions so that the fiber structure changes. In one embodiment of the method, said physical treatment is preferably selected form pressing and shearing or a combination thereof of said fiber source, thus impregnated vegetable fibrous material. A person skilled in the art could find other means for introducing physical energy into the system, but pressing and/or shearing are readily applicable to existing equipment.

The energy applied to the system ranges from 1 to 300, preferably from 1 to 100 kWh/t. Applying energy to physical treatment during impregnation, transfer circulation or cooking stages or there in between, is contrary to the teaching of common energy economics of kraft pulping. However, it has now been found that the overall benefit for the process in its entirety exceeds the value gainable by energy trade.

Figure 1:
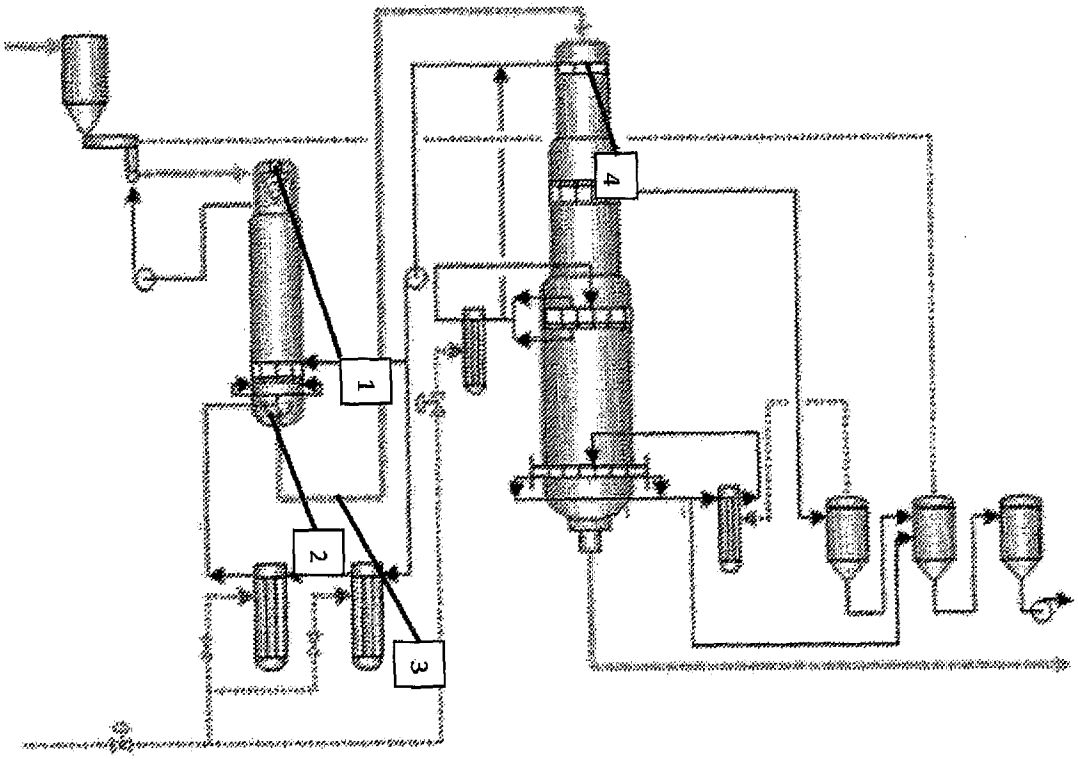
FIG. 1 represents schematically an example of a continuous cooking system, wherein the method according to the disclosed embodiments is employed in or after impregnation. Positions marked with reference characters 1 (top of impregnation vessel), 2 (bottom scraper), 3 (transfer circulation) and 4 (top seperator) show sites, wherein the treatment can be applied.
Figure 2:
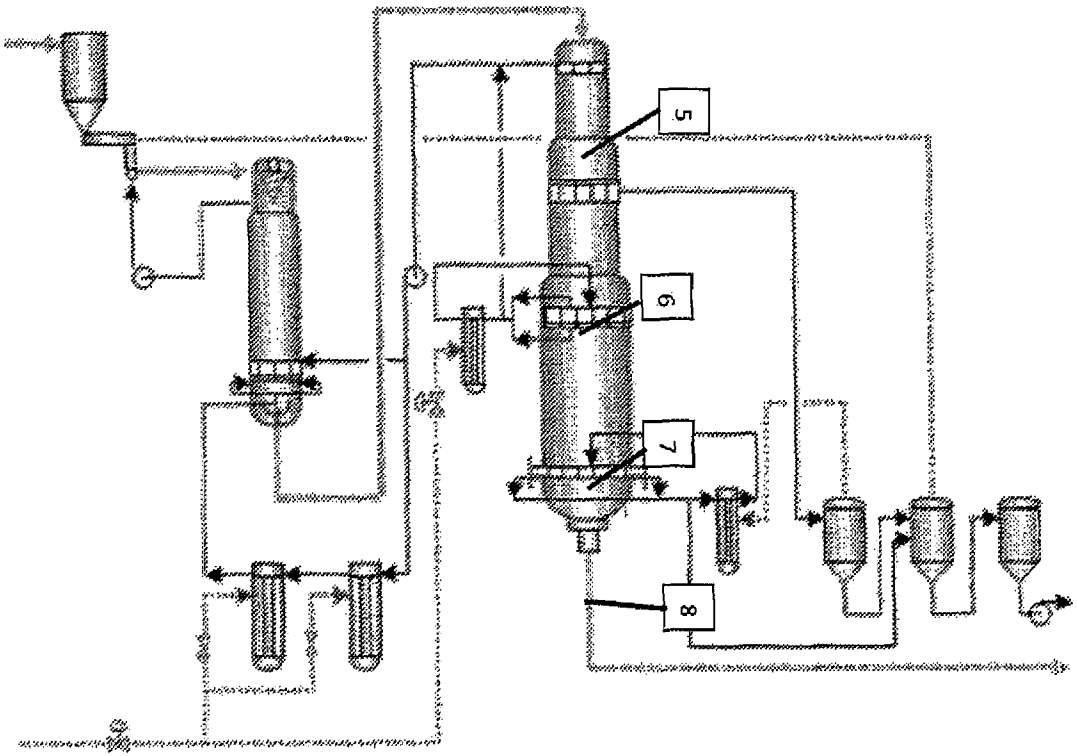
FIG. 2 shows, positions where the modified pressing and shearing devices can be placed in the cooking stage (position 5, $1^{st}$ cooking zone; position 6, $2^{nd}$ cooking zone; position 7, bottom scraper; and position 8, discharge line) in the digester and after digester of the continuous cooking system.

Other conditions for said treatment comprise alkali charge of 1-60 w-%, preferably a preferably 10-25 w-% as effective alkali, hence alkali charge in relation to dry weight of the fibre bulk. This amount has shown to have synergism in defibration and fiber structure change with the physical energy applied, yet not adversely affecting the fiber length and percent fines, and these qualities in final paper product thereof. Said conditions further comprise an effective temperature for increasing the swelling of the hemicelluloses and/or the lignin's and to reach material softness point. When selecting the temperature, said treatment temperature is preferably from, 50 to 250° C. and preferably 50 to 200° C., when the treatment is effected in at least one position selected from positions (1-4) as shown in FIG. 1. On the other hand, when the treatment is effected in at least one position selected from positions (5-8) as shown in FIG. 2, said treatment temperature is preferably from 140 to 250° C. and preferably from 140 to 175° C.

The change in the fiber structure is preferably done in the conditions of alkali charge and temperature sufficient for hemicelluloses and the lignins to reach their material softness points respectively. An artesan is familiar with these conditions based on e.g. literature (Salmen, L., Temperature and water induced softening behavior of wood fiber based materials. Department of Paper Technology, The Royal Institute of Technology. Stockholm, Dissertation 1982, 114p.).

Contrarily to observations in prior art documents, the present inventor has found, that optimal delignification of cell wall will inhibit rupture or damage of said cell wall.

Figure 6A:
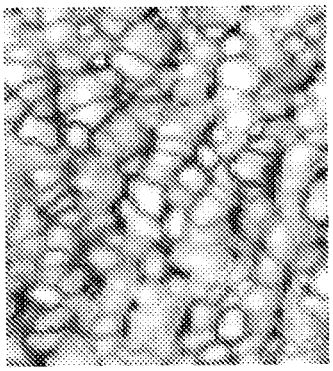
FIG. 6 gives comparison of not-opened (6*a*) and opened (6*b*) S2-layer of the eucalyptus fiber cell wall as an AFM cross cut. Opening (6*b*) has been effected according to method of the present invention. B refers to opened structure between cellulose aggregates showing as dark regions in the figure.
Figure 6B:
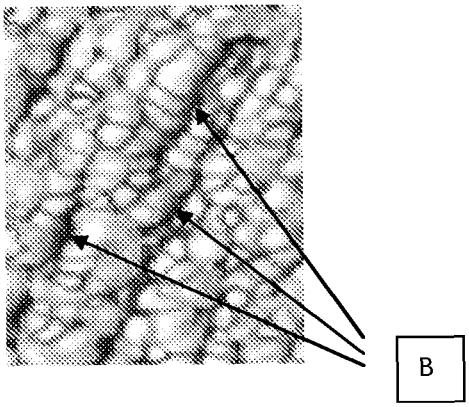

The authors of prior art publications have failed to recognize, that when the fibers are chemically defibered from the chip matrix and when fiber cell wall in the chip matrix is at least partially deliginified without intermediate washing, the fiber cell wall softens. Therefore the cell wall can be mechanically modified without damaging the cell wall, meaning increasing the void space between the cellulose aggregates, without damaging the cell wall. The fiber properties can be modified and controlled without losing cooking yield or increase of process time and the objective of the invention can be achieved. This has now been found to be related to increased pore area in the fiber cell wall. The opened and not opened $S_2$-layer of the eucalyptus fiber cell wall AFM cross cut is presented in the FIG. 6. This opening in the fiber cell wall structure affects and can be seen as increase in the dewatering speed, bulk, optical properties and surface smoothness at the same kappa number or cooking yield level.

Generally, the method according to the disclosed embodiments may be applied in at least one stage in the Kraft pulping process selected from impregnation, transfer circulation and cooking. The treatment can thus be incorporated into normal process steps involved in Kraft pulping. Alternatively, said treatment may be applied in at least one separate process step which is engineered to be before the Kraft pulping process, in the Kraft pulping process or after the Kraft pulping process. As a rule, the desired effect is only achieved for raw material impregnated but not washed.

The surprising dewatering characteristics are best observed and benefited when the method further comprises subsequent washing.

It is essential, that the fiber material to be pulped, e.g. wood chips, is impregnated prior to applying the treatment. Preferably said impregnation is conducted under pressure. The preferable application is the Kraft pulping process. The stages in the continuous Kraft cooking processes are impregnation, transfer circulation and cooking or immediately before or after Kraft cooking process. In the batch cooking processes it can be done at the same process stages as in the continuous process or alternatively, in can be incorporated as a separate process before, in, or after Kraft cooking process. An artisan understands that the vegetable fiber source can be impregnated with water at the simplest, however, preferably the composition typical for each stage, as mentioned above, is applied, e.g. respective impregnating, digesting or cooking liquor. However, even acidic impregnation is applicable, as long as the conditions are selected to be effective to reach material softness point of the hemicelluloses and/or the lignins.

Defibration, as used herein, refers to separation of the fibers in a fibrous material. It should be understood as disintegration of the vegetable source material into loose fibers or smaller fiber agglomerates in general. It is not restricted to mechanical defibering only. Pressing and/or shearing, as used in the method according to the disclosure, can lead to complete defibration into loose fibers or to partial defibration to fiber agglomerates; or without defibration or defibration to agglomerates, to separation of fibrill aggregates in the fiber cell wall. The bond between lamella and fibres may sustain the treatment, even though the fibres themselves undergo a change in fiber structure. As used herein, change in the fiber refers to modification of the single or agglomerated fibers, which affects at least part of the fiber wall, changing its properties. One preferable example is increasing of the porosity of the fibers. Porosity refers to cell wall porosity as measured with AFM or decrease in the WRV (water retention value).

The "change in fiber wall" can be seen as an increase in the pore size distribution measured of with atomic force microscopy (AFM)/3/ from resin bedded cross sections of the fibers or in decrease in the water retention value, in the SR value or increase of CSF value of the fibers in question while the chemical composition or kappa number remains unchanged.

In the final product, at least one layer contains fibers, such as cellulosic fibers. Cellulosic fibers which may be used are paper fibers, raw wood pulp, and non-wood fibers from jute, hemp, bagasse, coconut or straw.

As product by process in one embodiment, pulp having attractive characteristics is obtained. Pulp obtainable by method is usable for increasing dewatering and efficiency of paper product produced. Further, said pulp is usable for increasing optical properties of the paper product produced.

Said pulp is usable for increasing bulk of the of the paper product produced. Additionally, said pulp is used for increasing surface smoothness of the of the paper product produced. In board production, said pulp is usable for increasing bulk of dewatering of the of the board product produced. If not applied to papermaking, said pulp or biomaterial is usable for production of cellulose derivatives or biofuels.

The aspects of the disclosed embodiments are discussed in more detail in the following examples with reference to enclosed drawings. When explaining processes of the embodiments, reference patent numbers should be understood serving enablement purposes only, without limiting the scope of the present invention. In the drawings, FIG. 1 shows a process wherein the method is applied executing the treatment in or after impregnation. The treatment herein means pressing and/or shearing the impregnated wood chips at elevated temperatures so that the fiber matrix in the chip will be broken. The shearing and pressing can be done with e.g. conical plug feeder (U.S. Pat. No. 5,570,850) modified so that the surfaces of the feeder will provide with this action (for e.g. according to U.S. Pat. No. 4,953,795) in one or several of the positions numbered as 1, 2, and 4 in FIG. 1. This does not mean that other devices providing the similar action could not be used. The shearing and pressing at the position 2 can be carried out with modified bottom scraper (U.S. Pat. No. 5,736,005), which provides the action mentioned above by providing it with shearing plates. Other devices which can be applied after modification to these positions 1 to 4 are feed screws, pumps or presses according to U.S. Pat. No. 4,915,830 or 6,036,818, U.S. Pat. No. 5,622,598 or 20050053496 and U.S. Pat. No. 4,121,967. All of these modifications can be done by person who is expert in the field.

FIG. 2 shows process for example in the digester and after digester of the continuous cooking system with the modified pressing and/or shearing positions with devices presented in accordance to FIG. 1. In this embodiment, the shearing and pressing can be done with conical plug feeder (U.S. Pat. No. 5,570,850) modified so that the surfaces of the feeder provide with this action (e.g. according to U.S. Pat. No. 4,953,795) in the positions 5 and 8 in the FIG. 2. This does not mean that other devices providing the similar action could not be used. The shearing and pressing at the position 6 and 7 can be carried out with modified bottom scraper (U.S. Pat. No. 5,736,005), which provides the action mentioned above for e.g. by providing it with shearing plates. Also these positions can be provided with any kind of mixer or screw or press providing the shearing and pressing action of the fiber matrix. The position 8 can be provided with feed screws, pumps or presses after modification. Feasible examples can be found in U.S. Pat. No. 4,915,830 or 6,036,818, U.S. Pat. Nos. 5,622,598 and 4,121,967 or in US patent application 20050053496. All of these modifications can be done by person skilled in the art.

Figure 3:
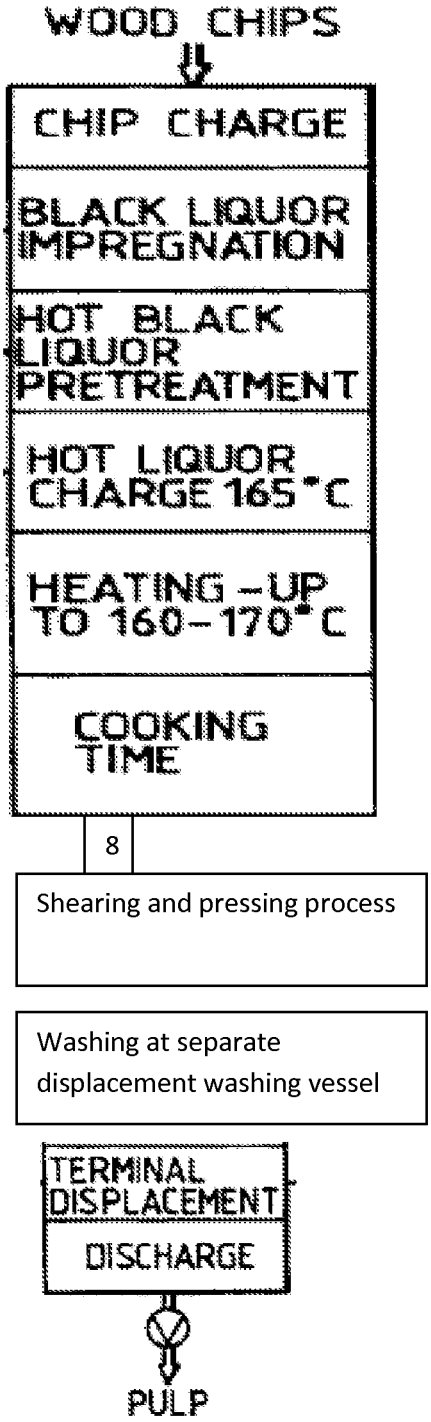
FIG. 3 shows as a flow chart the process steps from wood chips to pulp according to one embodiment.

According to another embodiment, said position 8 can as well be after batch cooking system as presented in the FIG. 3. Steps, wood chips are fed to pulping, chip charge, black liquor impregnation, hot black liquor pretreatment, hot liquor charge 165° C., heating up to 160-170° C. and cooking time are performed according to prior art processes. It shows the cooking system of U.S. Pat. No. 5,643,410, with the treatment step, wherein the pulp is by treatment transferred to separate displacement washing vessel. Steps are indicated as [8] shearing and pressing process, and washing at separate displacement washing vessel. Thereafter, as in prior art process, steps of terminal displacement and discharge result in pulp. By this arrangement, the high washing efficiency and heat economy and energy transfer of the pulp can be utilized.

Any one of these positions alone or any combination of these positions can be used in the method. The combination of these positions in the method is dependent of the properties of the pulp which are desired after cooking. The conditions can be typical to Kraft cooking process in the current positions or they can be modified to desired ones. In the examples the effects and treatments are presented more in detail. The pulp properties measurements are carried out with industry standards if not otherwise stated.

In the following paragraph, the aspects of the disclosed embodiments are described as numbered clauses.

1. A method of processing chemical pulp from a vegetable fiber source, wherein change in the fiber cell wall is effected by physical treatment of at least partially delignified vegetable fiber source.

2. The method according to clause 1, wherein said vegetable fiber source comprises wood chips.

3. The method according to clause 1 or 2, wherein said physical treatment is selected form pressing and shearing and a combination thereof, of said fiber source.

4. The method according to any one of the preceding clauses, wherein said change in fiber structure comprises increasing pore size of the fibers.

5. The method according to any one of the preceding clauses, wherein the conditions in said treatment comprises water up to 700 w-% and, an alkali charge of 1-60%, preferably alkali charge of 10%-25% as effective alkali based on the dry weight of the fibre raw material, or an acid charge of 1-60%, preferably acid charge of 10%-25% as effective acid based on the dry weight of the fibre raw material.

6. The method according to any one of the preceding clauses, wherein the conditions in said treatment is applied in a temperature effective for increasing the swelling of the hemicelluloses and/or the lignins and to reach material softness point.

7. The method according to any one of the preceding clauses, wherein the treatment is effected in at least one position selected from positions (1), (2), (3) and (4)

8. The method according to clause 7, wherein said treatment temperature ranges from 50 to 250° C. and preferably from 50 to 200° C.

9. The method according to one of the clauses 1-6, wherein the treatment is effected in at least one position selected from positions (5), (6), (7) and (8).

10. The method according to clause 9, wherein said treatment comprises a temperature from 50 to 250° C. and preferably from 140° C. to 175° C.

11. The method according to any one of the preceding clauses, wherein the said physical treatment comprises applying energy from 1 to 300, preferably, from 1 to 100 kWh/t.

12. The method according to any one of the preceding clauses, wherein said treatment is applied in at least one stage in the Kraft pulping process selected from impregnation, transfer circulation and cooking.

13. The method according to clause 12, wherein said treatment is applied in at least one separate process step selected from before the Kraft pulping process, in the Kraft pulping process or after the Kraft pulping process.

14. The method according to any one of the preceding clauses, wherein said treatment is followed by a washing step.

15. The method according to any one of the preceding clauses, wherein the consistency of the pulp subjected to said physical treatment is less than 70%, preferably from 10 to 30%, and most preferably less than 10%.

16. Pulp obtainable by the method according to any one of clauses 1-15.

17. Use of pulp obtainable by method according to any one of clauses 1-15 for increasing dewatering in paper product production.

18. Use according to clause 17, wherein the pulp is used for increasing dewatering and efficiency of paper product produced.

19. Use according to clause 17, wherein the pulp is used for increasing optical properties of the paper product produced.

20. Use according to clause 17, wherein the pulp is used for increasing bulk of the of the paper product produced.

21. Use according to clause 17, wherein the pulp is used for increasing surface smoothness of the of the paper product produced 22. Use according to clause 17, wherein the pulp is used for increasing bulk of dewatering of the of the board product produced.

23. Use according to clause 17, wherein the pulp or biomaterial is used for production of cellulose derivatives or biofuels.

Experimental Part

The effects obtainable by embodiments of the method of the disclosure are evidenced by the following experiments, which should not be considered as limiting the scope of the invention.

EXAMPLE 1

Figure 4A:
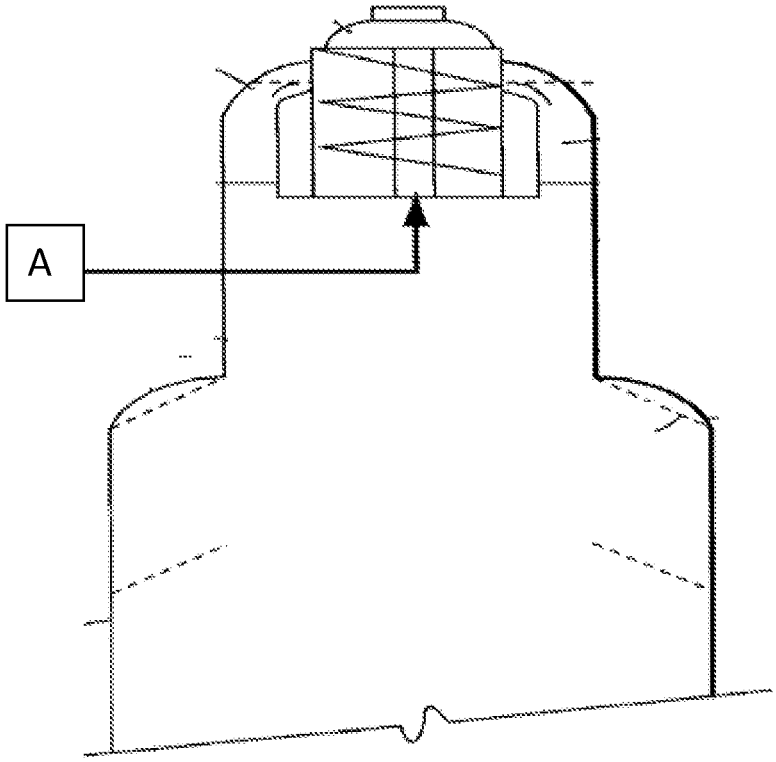
FIG. 4*a* shows a top separator according to U.S. Pat. No. 6,174,411, which is equipped with segmented surfaces.
Figure 4B:
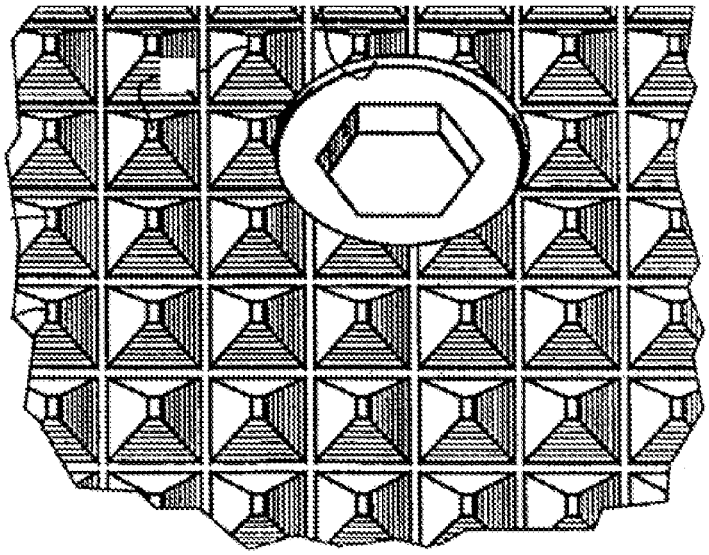
FIG. 4*b* illustrates segmented surfaces of the top separator of FIG. 4*a*. With the arrow marked in FIG. 4*a*, is indicated the pulp and black liquor flow to top separator (A). The present invention is however, not restricted to this equipment (4*b*), described in detail in U.S. Pat. No. 5,385,309, but any other equipment providing similar effect is equally applicable.
Figure 5:
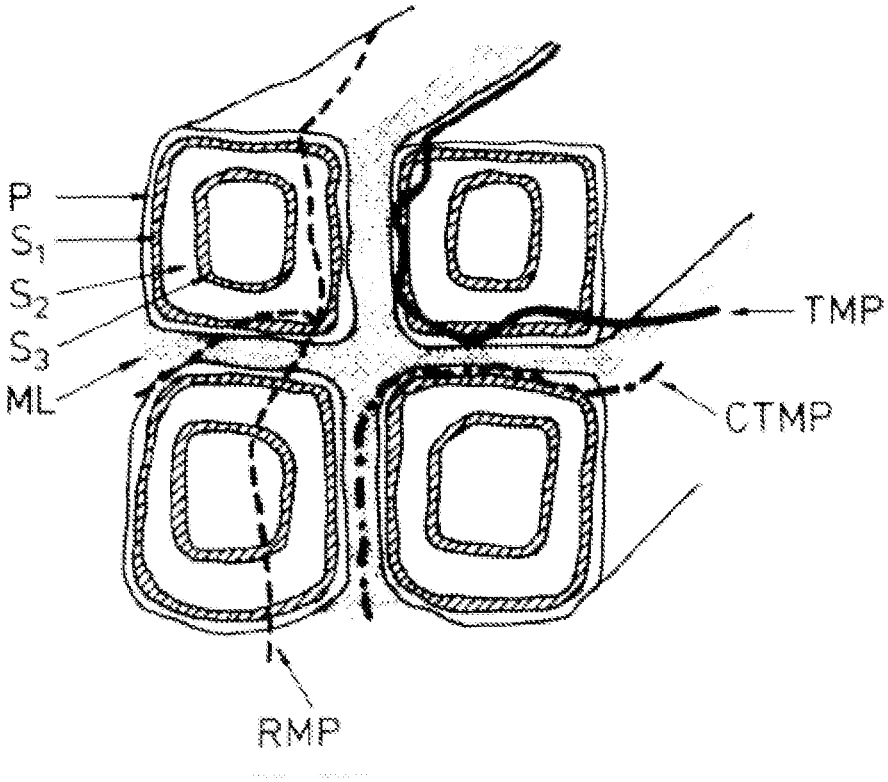
FIG. 5 is a schematic presentation from prior art of typical damages to the cell wall in wood chip fiberizing in different pulping processes. In this picture, (RMP refers to Refiner Mechanical Pulping, TMP refers to Thermo Mechanical Pulping, CTMP refers to Chemithermomechanical Pulping, P refers to primary cell wall, $S_1$ refers to Secondary cell wall 1, $S_2$ refers to Secondary cell wall 2, $S_3$ refers to Secondary cell wall 3, ML refers to middle lamella).

In this example eucalyptus wood pulp was produced according to an embodiment wherein top separator of continuous digester in position 5 was applied. The surfaces of the screw were equipped with segmented plates for shearing action (as presented in FIG. 4). This dimensioning of the equipment can be done by anyone who is expert in the field. Same effect can be achieved at positions 6, 7 and 8 of FIG. 2 and in the position 8 of FIG. 3, with the same equipment as presented above. Typical conditions in these positions are: temperature 140° C.-200° C. and alkali charge as effective alkali as $Na_2O$ of about 20%. The energy applied is 10-100 kWh/t. The cooking results are presented in the Table 1.

TABLE 1

| Analysis | REF *eucalyptus* pulp | Method applied in position 5 for *eucalyptus* pulp |
|---|---|---|
| Kappa number | 18 | 17.8 |
| Cooking yield, % | 53.2 | 53 |
| Viscosity, ml/g | 1340 | 1315 |

The above results confirm that the method does produce same cooking yield and viscosity of the pulp cooked from same raw material.

EXAMPLE 2

In this example was shown the pulp properties produced from hardwood (eucalyptus) when the method was applied in the position 5. The results are shown in Table 2 in comparison to pulp produced from same raw material without the method (control sample noted as REF). Porosity is determined as AFM. The results are given as pore area [$nm^2$], water retention value, WRV [g/g] and Schopper-Riegler number (SR).

TABLE 2

| Analysis | REF *eucalyptus* pulp | Method applied in position 5 for *eucalyptus* pulp |
|---|---|---|
| Pore area (AFM), $nm^2$ | 8000 | 16000 |
| WRV, g/g | 2.09 | 1.72 |
| SR | 20 | 16 |

The above results confirm that the method increases the pore area and decreases water retention value and SR number.

EXAMPLE 3

In this example eucalyptus wood pulp was produced according embodiments applying the method in position 2 of FIG. 1. Typical conditions in these positions are: temperature 50° C.-150° C. and alkali charge as effective alkali 15%. The cooking results are presented in Table 3.

TABLE 3

| Analysis | REF *eucalyptus* pulp | Method applied in position 2 for *eucalyptus* pulp |
|---|---|---|
| Kappa number | 18.2 | 18.0 |
| Cooking yield, % | 53 | 53.2 |
| Viscosity, ml/g | 1300 | 1280 |

The above results confirm that the method does produce same cooking yield and viscosity of the pulp cooked from same raw material.

EXAMPLE 4

In this example is shown the pulp properties produced from hardwood (eucalyptus) when the method was applied in position 2. The results are shown in Table 4 in comparison to pulp produced from same raw material without treatment.

TABLE 4

| Analysis | REF *eucalyptus* pulp | Method applied in position 2 for *eucalyptus* pulp |
|---|---|---|
| Pore area (AFM), $nm^2$ | 8200 | 12700 |
| WRV, g/g | 2.11 | 1.87 |
| SR | 20 | 18 |

The above results confirm that the method increases the pore area and decreases water retention value and SR number.

EXAMPLE 5

In this example is shown the bleaching chemical consumption ($ClO_2$ consumption) (DEDED sequence to 90 ISO brightness) of pulp produced from hardwood (eucalyptus) when the method was applied in position 2. The $ClO_2$ charges are presented as weight-%). The results are shown in Table 5 in comparison to pulp produced from same raw material without the applied method.

TABLE 5

| phase | REF *eucalyptus* pulp, $ClO_2$ consumption, % | Method applied in position 2 for *eucalyptus* pulp; $ClO_2$ consumption, % |
|---|---|---|
| D0 | 3.02 | 2.75 |
| D1 | 1.75 | 1.5 |
| D2 | 0.5 | 0.5 |
| Total | 5.27 | 4.75 |

The above results confirm that the method decreases the consumption of the $ClO_2$ bleaching chemicals.

EXAMPLE 6

In this example is shown the dewatering measured with vacuum de watering device at −30 kPa. This devise simulates the fiber line filter washer dewatering and paper machine wire section dewatering. Pulp from hardwood (eucalyptus) was produced when the method was applied in position 2. The results are shown as dewatering time as seconds. When the dewatering becomes faster the dewatering time decreases as can be seen from results shown in Table 6.

TABLE 6

| | Unbleached REF *eucalyptus* pulp, 3 kg/m2 | Method applied in position 2 for unbleached *eucalyptus* pulp, 3 kg/m2 |
|---|---|---|
| Time, s | 19 | 13 |
| | Bleached REF *eucalyptus* pulp, 80 g/m2 | Method applied in position 2 for bleached *eucalyptus* pulp, 80 g/m2 |
| Time, s | 1.4 | 0.8 |

The above results confirm that the method increases the productivity of any pulp mill fiber line or any paper machine when pulp is produced according the present invention.

EXAMPLE 7

In this example is shown the dynamic tension of wet web strength of the pulp after wire section of paper machine produced from hardwood (eucalyptus) when the method is applied in the position 2 of FIG. 1. The results are shown in Table 7 in comparison to pulp produced from same raw material without the applied method.

TABLE 7

| Dynamic tension of the pulp after wire section | REF *eucalyptus* pulp | Method applied in position 2 for *eucalyptus* pulp |
|---|---|---|
| N/m at strain 1% | 65 | 98 |

The above results confirm that the method increases the production of the paper machine when the pulp formed using the method of the disclosure is used.

EXAMPLE 8

In this example are shown the optical properties and porosity of the pulp produced from hardwood (eucalyptus) when the method was applied in positions 2 of FIG. 1. The results after Voith Sulzer refining to 45 kWh/t are shown in Table 8 in comparison to pulp produced from same raw material without the applied method (REF).

TABLE 8

| Property | REF *eucalyptus* pulp | Method applied in position 2 for *eucalyptus* pulp |
|---|---|---|
| Brightness, % ISO | 90 | 90 |
| Light scattering, $m^2/g$ | 41 | 45 |
| Opacity, % | 73 | 78.8 |
| Air res., s | 0.7 | 0.3 |

The above results confirm that the method improves the optical properties and increases porosity of the paper when the pulp formed using the method of the disclosure is used.

EXAMPLE 9

In this example is shown the surface topography of wire side of the pulp produced from hardwood (eucalyptus) when the method was applied in position 2 of FIG. 1. The results are shown in Table 9 in comparison to pulp produced from same raw material without the applied method.

TABLE 9

| Wire side surface topography range, mm | REF *eucalyptus* pulp, consumption, micrometers | Method applied in position 2 for *eucalyptus* pulp |
|---|---|---|
| 0-0.15 | 1.03 | 0.8 |
| 0.15-0.80 | 4.7 | 4.7 |
| 0.80-1.6 | 13 | 7.2 |
| 1.6-4.0 | 22 | 14.7 |

The above results confirm that the method improves the surface topography of the wire sides (all moderns formers are gap formers) of the paper when the pulp according the present disclosure is used.

EXAMPLE 10

In this example is shown the bulk of the pulp produced from hardwood (eucalyptus) when the method was applied in position 2 of FIG. 1. The results are shown in Table 10 in comparison to pulp produced from same raw material without the applied method.

TABLE 10

| | REF *eucalyptus* pulp | Method applied in position 2 for *eucalyptus* pulp |
|---|---|---|
| Bulk, $cm^3$ | 1.75 | 2.1 |

The above results confirm that the method improves bulk of the paper when the pulp according the present disclosure is used.

EXAMPLE 11

In this example is shown the accessibility of the cellulosic fibers on the enzymatic digestion when the method of was applied in position 2 of FIG. 1. The stain results are shown in Table 12 in comparison to pulp (REF eucalyptus) produced from same raw material without the applied method.

TABLE 11

| | REF *eucalyptus* pulp | Method applied in position 2 for *eucalyptus* pulp |
|---|---|---|
| Orange stain, % | 70 | 80 |
| Blue stain, % | 30 | 20 |

The above results confirm that the method increases the accessibility for enzymatic digestion of cellulosic material.

EXAMPLE 12

In this example is shown the accessibility of the cellulosic fibers on the EWNN breaking down the cellulose when the method was applied in position 2 of FIG. 1. The results are shown in Table 13 in comparison to pulp produced from same raw material (REF) without the applied method.

TABLE 12

| | REF *eucalyptus* pulp | Method applied in position 2 for *eucalyptus* pulp |
|---|---|---|
| Swelling Affinity | 2 | 2.3 |
| Dissolution velocity | 1.4 | 1.6 |

The above results confirm that the method increases the accessibility of cellulosic material.

EXAMPLE 13

In this example is shown that using low pulp consistency (10%) in the method is beneficial for the accessibility of the cellulosic fibers on the EWNN breaking down the cellulose. The method was applied in position 2 of FIG. 1. Normally the pulp consistency is increased to 25-35% after Kraft cooking in subsequent pulp washing. The results are shown in Table 13 in comparison to pulp produced from same raw material without the applied method. Surprisingly, the pulp treated according to the method of the disclosure shows decreased tendency to aggregate when in low concentrations. Therefore, the present invention can be applied in consistency as low as <30%, preferably 10-30%, and most preferably <10%.

TABLE 13

| | REF pulp *eucalyptus*, consistency 30% | Method applied in position 2 for *eucalyptus* pulp consistency 10% |
|---|---|---|
| Swelling Affinity | 2 | 2.4 |
| Dissolution velocity | 1.4 | 1.7 |
| Pore Area | 8000 $nm^2$ | 17500 $nm^2$ |
| Aggregate size | 16 nm | 13.5 nm |

The above results confirm that the method in low consistency increases the accessibility of cellulosic material. Also the decreased cellulose aggregate size shows that the accessible surface area is increased.

The invention claimed is:

1. A method of processing chemical eucalyptus pulp in a cooking stage in a Kraft pulping process comprising, adding to an impregnated eucalyptus fibre flow:

an alkali charge of 1%-60% as effective alkali as $Na_2O$;

adjusting the temperature between 50° C. to 200° C. effective for increasing a swelling of hemicelluloses and/or lignins and to reach a material softness point;

applying with segmented plates physical treatment to the fibre flow; and maintaining conditions until opening the S-2 pore size of the fibre cell wall without rupturing or damaging the cell wall.

2. The method according to claim 1, wherein said impregnated eucalyptus fibre flow comprises wood chips.

3. The method according to claim 1, wherein the conditions in said physical treatment comprise an alkali charge of 10%-25% as effective alkali as $Na_2O$.

4. The method according to claim 1, wherein said temperature of said physical treatment ranges from about 140° C. to 175° C.

5. The method according to claim 1, wherein the said physical treatment comprises applying energy from 1 to 100 kWh/t.

6. The method according to claim 1, wherein said physical treatment further comprises washing.

7. The method according to claim 1 wherein the pore size is greater than 8200 $nm^2$-12700 $nm^2$ as measured by AFM.

8. The method according to claim 1 wherein the pore size is about 12700 $nm^2$ as measured by AFM.

9. The method according to claim 1 wherein the pore size is about 17500 $nm^2$ as measured by AFM.

10. The method according to claim 1 wherein the pore size is greater than 8200 $nm^2$-17500 $nm^2$ as measured by AFM.

11. The method according to claim 1 wherein the fibre flow receiving physical treatment is unwashed and the method comprises washing after the S-2 pore size of the fibre cell wall has opened.

12. A method of processing chemical eucalyptus pulp from a vegetable fibre source in the transfer circulation stage of a Kraft pulping process comprising, adding to an impregnated eucalyptus fibre flow:

an alkali charge of about 1%-60% as an effective alkali as $Na_2O$;

adjusting the temperature between 50° C. to 200° C. effective for increasing a swelling of a hemicelluloses and/or lignins and to reach a material softness point;

applying with segmented plates physical treatment to the fibre flow selected from pressing, shearing or a combination thereof; and maintaining conditions until opening the S-2 pore size of the fibre cell wall without rupturing or damaging the cell wall.

13. The method according to claim 12, wherein said physical treatment is applied in at least one further stage selected from before the Kraft pulping process, in the Kraft pulping process or after the Kraft pulping process.

14. The method according to claim 12, wherein said eucalyptus fibre flow comprises eucalyptus wood chips.

* * * * *